United States Patent [19]

Papanikolaou

[11] 4,094,062

[45] June 13, 1978

[54] ILLUMINATED RAZOR

[76] Inventor: Sotirios Papanikolaou, 407 Church St., Hasbrook Heights, N.J. 07604

[21] Appl. No.: 663,980

[22] Filed: Mar. 4, 1976

[51] Int. Cl.[2] ..... B26B 19/46

[52] U.S. Cl. ..... 30/34 R; 30/86

[58] Field of Search ..... 30/34 R, 86, 123 R; 145/50 R; 240/1 EL, 1 LP, 2 BB

[56] References Cited

U.S. PATENT DOCUMENTS

| | | | |
|---|---|---|---|
| 2,546,928 | 3/1951 | Masabny | 30/34 R X |
| 3,275,815 | 9/1966 | Golaz | 240/1 EL X |
| 3,811,188 | 5/1974 | Brenneman | 30/34 R |

FOREIGN PATENT DOCUMENTS

| | | | |
|---|---|---|---|
| 878,882 | 11/1942 | France | 30/34 R |
| 887,027 | 1/1962 | United Kingdom | 30/34 R |

*Primary Examiner*—Gary L. Smith

[57] ABSTRACT

A razor provided with directive means for illuminating the area just previously shaved. The razor is formed of plastic and is provided with a sealed electric circuit including a bulb. The razor head is formed of a light conductive and partially reflective acrylic plastic of translucent material for piping light around corners.

5 Claims, 3 Drawing Figures

ILLUMINATED RAZOR

FIELD OF THE INVENTION

This invention relates to razors in general.

BACKGROUND OF THE INVENTION

Description of the Prior Art

At present it is customary to use various types of razors for shaving, such as electric razors, safety razors, straight razors and various safety razors afforded with sophisticated safety provisions. As a general rule, means for directing light on the areas to be shaved or which have been shaved are not the custom.

There are razors with provisions for lighting the shaving area that are now known. For example, U.S. Pat. No. 1,900,965 (Weiss) and U.S. Pat. No. 3,131,286 (Schneiderman) illustrate such devices. However, the presently known razors provided with light means are bulky, cumbersome objects which lack light directivity and which require considerable sealing provisions to avoid electrical short circuits due to water contact in the circuit.

SUMMARY OF THE INVENTION

The present invention provides an illuminated razor directing a light beam to the area which has been just previously shaved. The invention relies on the configuration of the razor and material of the razor head to provide directive light and thereby avoid the need to oversize the razor to provide the light circuit.

The invention is applicable to virtually any razor, however, the preferred embodiment is well suited for use in conventional safety razors. In a conventional safety razor a bulb is provided at the neck of the razor, the energy source for the bulb is stored in the razor handle and the razor head is formed of transparent or translucent plexiglas or similar material to pass the light from the bulb. The back of the head is configured at an angle between 30° and 60°, preferably 45°, to reflect the light from the bulb through the razor heat at a location just above the blade. Thus, the light is focused on the area directly behind the blade, i.e. the area which has just been shaved. In one embodiment of the invention the inclined surface of the head which reflects the light is silvered or otherwise made opaque to enhance reflectivity and further direct the light to the desired area.

DESCRIPTION OF THE PREFERRED EMBODIMENT

The preferred embodiment of the present invention is shown having application in a conventional safety razor. The invention is applicable in any razor device in which capacity exists to store a power source and electrical circuit for a bulb and critically locate a bulb and a transparent or translucent light beam directive head.

Figure 1:
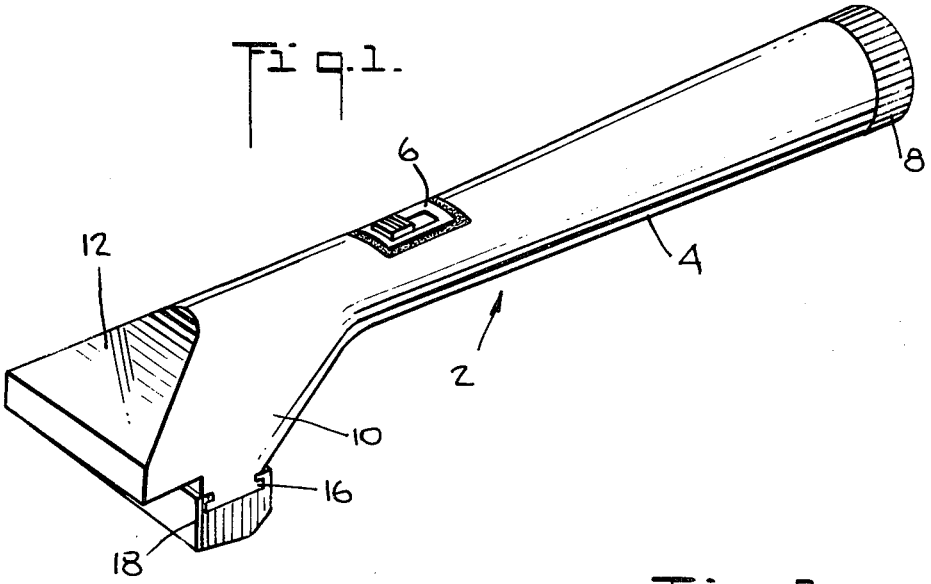
FIG. 1 is an isometric view of the razor of the subject invention.

As best seen in FIG. 1, the razor 2 of the subject invention is shown in isometric view. The exterior of the handle 4 of the razor 2 is conventional except for the addition of a switch 6 and a closure 8 for an internal cavity. The head 10 of the razor is configured similarly to the conventional razor but is formed of transparent or generally transparent material and is provided with a reflective surface 12 at the rear. The reflective surface 12 is formed at an angle of 30°-60°, preferably 45°, to the axis of the razor handle. The razor is also provided with a forward surface 14 which is directly above the blade holding area.

Figure 2:
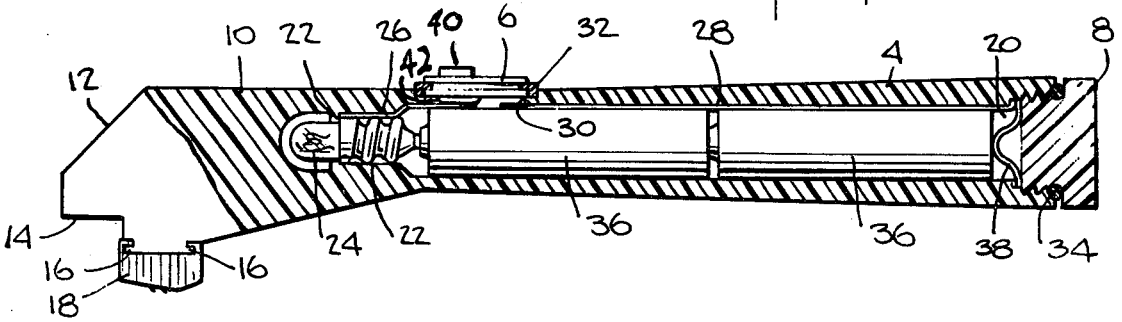
FIG. 2 is a partial sectional elevational view taken through the axial centerline of FIG. 1.
Figure 3:
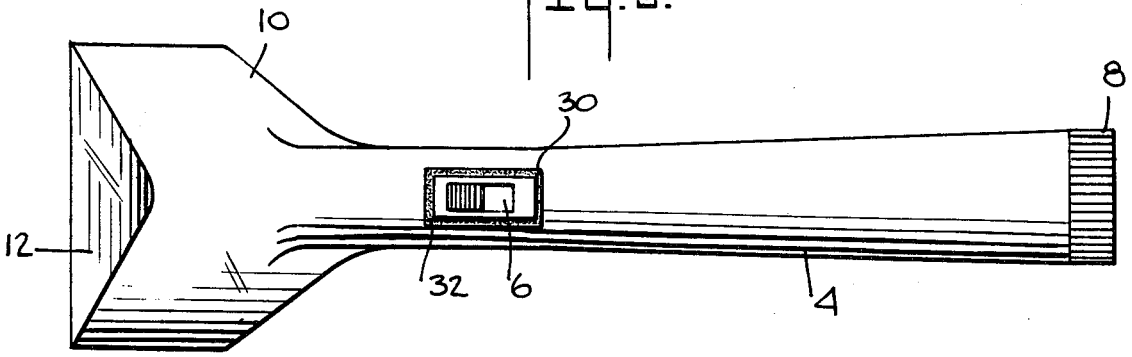
FIG. 3 is a plan view of the razor showing the outside switch and the reflective area of the preferred embodiment.

As best seen in FIG. 2, the forward surface 14 is directly above the area at which the conventional blade or blade assembly 18 is located. Also, as best seen in FIGS. 1 and 2, the forward surface 14 is spaced apart from the conventional blade assembly 18 such that when the blade assembly 19 is in contact with the surface being shaved, the surface 14 will not be touching the surface being shaved. As depicted in FIG. 2, the razor is provided with flanges 16 to hold a double edge blade carrier 18 such as the SHICK Injection Double Blade.

A cavity 20 is provided in the handle 4 to accommodate the power source such as batteries 36 and a bulb 24 as best seen in FIG. 2. The cavity is sized to maintain the batteries 36 and the bulb 24 in alignment and urged into contact when the cavity 20 is closed. Shoulders 22 are provided in the forward end of the cavity 20 adjacent the head 10 of the razor to align the bulb 24. A conductor 26 extends from the bulb to the switch 6 on the handle. The switch 6 has a button 40 and an internal conductive member 42. The button 40 moves axially to move the member 42 into and out of engagement with conductor 28 to open and close the electrical circuit. The gap between aligned conductors 26 and 28 is smaller than the length of the member 42. A conductor 28 extends from the switch 6 to the rear of the cavity 20 where it contacts the closure 8. The closure 8 is provided with a spring-like conductive surface 38 to positively bear against batteries 36 and urge the batteries 36 and bulb 24 into engagement when the closure 8 is screwed into place so that the batteries 36 can provide the power to illuminate the light when the circuit is closed. When the closure 8 is removed the batteries 36 and the bulb 24 are free to slide out of the cavity 20.

The handle is provided with an opening 30 to the cavity 20. The switch 6 is located in the opening 30 and a diaphragm seal 32 surrounds the switch to prevent moisture from entering the cavity 20 to cause an inadvertent short circuit. The closure 8 is also provided with an annular seal 34 to afford a water-tight closure for the cavity 20.

The head 10 of the razor is formed of a plexiglas material which is transparent or translucent and affords passage of the light from the bulb 24. The top rear of the surface 12 is configured at an angle between 30°-60°, preferably 45°, to the axis of the handle and thereby affords directivity of the light emanating from the bulb 24 to the surface just above the razor blade. Silvering or similar opaque surface of the incline 12 is provided to further enhance reflectivity of the light. The front 14 of the razor above the blade or blade holder area is essentially flat and further affords passage of the light directed from incline 12 to focus such light on the area which has just been shaved. A material which is particularly suitable for use as the head material is LUCITE, a synthetic material made by duPont which material can be used to pipe light around corners. Rohm & Haas of Philadelphia, Pennsylvania also manufactures an acrylic plastic that is clear, colorless and transparent which can be used in the razor head of this invention.

I claim:

1. A razor having a head and a handle on the head comprising:

(a) means for mounting a razor blade on the front of the head;

(b) a razor blade mounted on the front of the head facing outwardly from the head and the handle;

(c) an electrical circuit entirely within the handle of the razor;

(d) a power source in the electrical circuit;

(e) a light bulb in the circuit;

(f) a razor head formed of transparent material having a rear surface arranged at an angle between 30° and 60° to the axis of the razor handle for directing the light from the bulb to the area above the razor blade in the direction which the razor blade faces;

(g) a coating of an opaque reflective substance on the rear surface of the razor head;

(h) a switch in the circuit; and (i) means for sealing the electrical circuit from water.

2. A razor as in claim 1 wherein the razor head is configured with a forward surface aligned with the rear surface, which forward surface is spaced apart from the razor blade such that when the razor blade is against the surface being shaved the forward surface of the head is not touching the surface being shaved.

3. A razor having a head and a handle on the head comprising:

(a) means for mounting a razor blade on the front of the head;

(b) a razor blade mounted on the front of the head facing outwardly from the head and the handle;

(c) an electrical circuit entirely within the handle of the razor;

(d) a power source in the electrical circuit;

(e) a light bulb in the circuit;

(f) a razor head formed of a light conductive and partially reflective acrylic plastic of translucent material for piping light around corners and having a rear surface arranged at an angle between 30° and 60° to the axis of the razor handle for directing the light from the bulb to the area above the razor blade in the direction which the razor blade faces;

(g) a switch in the circuit; and (h) means for sealing the electrical circuit from water.

4. A razor as in claim 3 wherein the means for directing the light from the bulb to the area above the razor blade in the direction which the razor blade faces is a razor head formed of translucent material having a rear surface arranged at an angle of 45° to the axis of the razor handle.

5. A razor as in claim 3 wherein the razor head is configured with a forward surface aligned with the rear surface, which forward surface is spaced apart from the razor blade such that when the razor blade is against the surface being shaved the forward surface of the head is not touching the surface being shaved.

* * * * *